US010080446B2

(12) United States Patent
Windrich

(10) Patent No.: US 10,080,446 B2
(45) Date of Patent: Sep. 25, 2018

(54) REFRIGERATED SALES FURNITURE

(71) Applicant: Carrier Corporation, Farmington, CT (US)

(72) Inventor: Ruediger Windrich, Mainz (DE)

(73) Assignee: CARRIER CORPORATION, Farmington, CT (US)

( * ) Notice: Subject to any disclaimer, the term of this patent is extended or adjusted under 35 U.S.C. 154(b) by 0 days.

(21) Appl. No.: 15/317,317

(22) PCT Filed: Jun. 11, 2014

(86) PCT No.: PCT/EP2014/062141
§ 371 (c)(1),
(2) Date: Dec. 8, 2016

(87) PCT Pub. No.: WO2015/188860
PCT Pub. Date: Dec. 17, 2015

(65) Prior Publication Data

US 2017/0135498 A1 May 18, 2017

(51) Int. Cl.
*A47F 3/04* (2006.01)
*F25D 23/02* (2006.01)
(Continued)

(52) U.S. Cl.
CPC ..... *A47F 3/043* (2013.01); *A47F 3/0434* (2013.01); *E05D 3/02* (2013.01); *E05D 5/0246* (2013.01);
(Continued)

(58) Field of Classification Search
CPC ..... A47F 3/043; A47F 3/0434; F25D 23/04; F25D 23/025; F25D 23/028; E05D 3/02;
(Continued)

(56) References Cited

U.S. PATENT DOCUMENTS 913,504 A * 2/1909 Jones ..... E05D 3/02 16/263
2,522,989 A 9/1950 Carbary
(Continued)

FOREIGN PATENT DOCUMENTS

CN 2404418 Y 11/2000
CN 1788653 A 6/2006
(Continued)

OTHER PUBLICATIONS

International Search Report and Written Opinion for PCT/EP2014/062141, dated Mar. 24, 2015, 9 pages.
(Continued)

*Primary Examiner* — James Orville Hansen
(74) *Attorney, Agent, or Firm* — Cantor Colburn LLP

(57) ABSTRACT

A refrigerated sales furniture (1) comprises at least one refrigerated goods storage space (2); at least two doors (3, 5) providing access to the refrigerated goods storage space (2), the at least two doors (3, 5) comprising a lower door (5) and an upper door (3) arranged on top of the lower door (5). The refrigerated sales furniture (1) further comprises a hinge (4), which is arranged between the upper door (3) and the lower door (5) for supporting the upper door (3) on the lower door (5) and allowing the doors (3, 5) to pivot around a vertical axis (A) independently from each other. The hinge (4) includes an upper pin (13) attached to or integral with the upper door (3) and a lower pin (11) attached or integral with to the lower door (5), the upper pin (13) is supported by the lower pin (11) and the two pins (11, 13) are rotatable with respect to each other around the vertical axis (A).

14 Claims, 4 Drawing Sheets

(51) Int. Cl.

| | |
|---|---|
| ***E05F 1/00*** | (2006.01) |
| ***F25D 23/04*** | (2006.01) |
| ***E05D 5/02*** | (2006.01) |
| ***E05D 3/02*** | (2006.01) |
| ***E05D 7/081*** | (2006.01) |
| ***E05D 11/00*** | (2006.01) |

(52) U.S. Cl.
CPC ..... *E05D 7/081* (2013.01); *E05D 11/0081* (2013.01); *E05F 1/00* (2013.01); *F25D 23/025* (2013.01); *F25D 23/028* (2013.01); *F25D 23/04* (2013.01); *E05Y 2900/202* (2013.01); *F25D 2323/024* (2013.01)

(58) Field of Classification Search
CPC ... E05D 5/0246; E05D 7/081; E05D 11/0081; E05F 1/00
USPC ..... 312/401, 405, 116, 138.1
See application file for complete search history.

(56) References Cited

U.S. PATENT DOCUMENTS

| | | | | |
|---|---|---|---|---|
| 3,395,423 | A * | 8/1968 | Bus | F16B 12/22 16/262 |
| 3,430,386 | A * | 3/1969 | Schmitt | E05D 3/04 312/109 |
| 4,084,291 | A | 4/1978 | Crowe | |
| 4,151,681 | A * | 5/1979 | Roberts | E05D 3/04 312/321.5 |
| 4,609,234 | A | 9/1986 | Naniwa et al. | |
| 5,187,837 | A | 2/1993 | Gunderson et al. | |
| 5,272,789 | A | 12/1993 | Mitchell et al. | |
| 5,346,297 | A * | 9/1994 | Colson, Jr. | E05B 47/023 312/215 |
| 5,787,724 | A | 8/1998 | Pohl et al. | |
| 6,192,630 | B1 | 2/2001 | Banicevic et al. | |
| 6,406,108 | B1 * | 6/2002 | Upton | A47F 3/001 312/116 |
| 7,322,209 | B2 | 1/2008 | Hwang et al. | |
| 7,506,474 | B2 | 3/2009 | Yoshikawa et al. | |
| 8,444,238 | B2 | 5/2013 | Choi | |
| 8,579,394 | B2 | 11/2013 | Lee et al. | |
| 2011/0001413 | A1 * | 1/2011 | Park | E05D 7/0027 312/405 |
| 2011/0266929 | A1 * | 11/2011 | Michael | F21V 33/0012 312/107 |
| 2012/0235551 | A1 | 9/2012 | Park et al. | |
| 2013/0002098 | A1 | 1/2013 | Jafa | |
| 2013/0026900 | A1 | 1/2013 | Oh et al. | |

FOREIGN PATENT DOCUMENTS

| | | | |
|---|---|---|---|
| CN | 200945019 | Y | 9/2007 |
| CN | 202055670 | U | 11/2011 |
| DE | 2048814 | A1 | 4/1972 |
| DE | 69316904 | T2 | 7/1998 |
| EP | 0668476 | A1 | 8/1995 |
| EP | 2142733 | A2 | 1/2010 |
| EP | 2495516 | A2 | 9/2012 |
| EP | 2500678 | A2 | 9/2012 |
| EP | 2521889 | A1 | 11/2012 |
| EP | 2522938 | A2 | 11/2012 |
| EP | 2585775 | A2 | 5/2013 |
| WO | 2007087699 | A1 | 8/2007 |
| WO | 20080119641 | A2 | 10/2008 |
| WO | 2012007298 | A1 | 1/2012 |

OTHER PUBLICATIONS

Chinese First Office Action for application 201480079743.0, dated Aug. 7, 2017, 10 pages.
Chinese Second Office Action for application 201480079743.0, dated Dec. 19, 2017, 9 pages.

* cited by examiner

REFRIGERATED SALES FURNITURE

The invention is related to a refrigerated sales furniture, in particular to a refrigerated sales furniture comprising at least two doors providing access to at least one refrigerated goods storage space. The invention is further related to mounting at an upper door and a lower door to such an refrigerated sales furniture.

PRIOR ART

In the past refrigerated sales furnitures have been equipped with doors extending over the full height of the refrigerated sales furniture. Thus, upon opening the door, the goods storage space (merchandise display area) has been exposed to the environment over the full height of the furniture. This is disadvantageous from a practical point of view, since a large and heavy door has to be moved. Doors for low temperature refrigeration display cabinets usually are provided with thermal insulating glass, having a very high weight, in order to provide a good thermal insulation. It is also disadvantageous from an energetic point of view, as opening the only door provides a large opening allowing extensive thermal exchange between the refrigerated goods storage space and the warm environment.

In a new kind of refrigeration display cabinets, the front side therefore is divided into upper and lower doors selectively allowing separate access to upper and lower portions of the refrigerated goods storage space.

Accordingly, it would be beneficial to provide an improved hinge mechanism for fixing and supporting a plurality of doors provided at the front side of a refrigerated sales furniture.

Exemplary Embodiments of the Invention

In an exemplary embodiment of the invention a refrigerated sales furniture comprises at least one refrigerated goods storage space and at least two doors, respectively providing access to the refrigerated goods storage space. The at least two doors include a lower door and an upper door arranged on top of the lower door. The refrigerated sales furniture further comprises a hinge, which is arranged in a gap formed between the upper door and the lower door for supporting the upper door on the lower door and allowing the doors to pivot around a vertical axis independently from each other. The hinge compromises an upper pin attached to or integral with the upper door and a lower pin attached to or integral with the lower door. The upper pin is supported by the lower pin and the two pins are rotatable with respect to each other around the vertical axis.

An exemplary method of mounting at an upper door and a lower door to an refrigerated sales furniture, wherein the upper door comprises an upper pin at its bottom; the lower door comprises a lower pin at its top; and one of the pins is formed as a female pin comprising an opening which is configured for receiving and accommodating at least a portion of the other pin, which is formed as a male pin; comprises the steps of attaching the bottom of the lower door to the refrigerated sales furniture at a lower hinge; introducing the male pin into the female pin in order to support the upper door onto the lower door; attaching the top of the upper door to the refrigerated sales furniture at an upper hinge; and securing the pins against a movement in horizontal direction by means of a bracket which is fixed to the refrigerated sales furniture, in particular to a frame of the refrigerated sales furniture.

In a refrigerated sales furniture according to exemplary embodiments of the invention the gap, which is present between the upper door and the lower door, can be minimized for providing a large access area to the goods storage space allowing an easy and convenient access.

In a refrigerated sales furniture according to exemplary embodiments of the invention the weight of the upper door rests completely upon the lower door, which is supported by the cabinet's carcass. Thus, the frame of the refrigerated sales furniture needs to provide less stability compared to a case in which the upper door is supported by the frame. It therefore can be produced lighter and cheaper. As the connecting between the hinge and the frame does not bear any considerable weight, it can be produced at low costs, as well. Additionally, the hinge formed by the two pins is easy to assemble.

The exemplary embodiments of the invention can be used in any kind of refrigerated sales furnitures without the need for structural modifications.

Exemplary embodiments of the invention will be described in the following with reference to the enclosed figures.

SHORT DESCRIPTION OF THE FIGURES

DETAILED DESCRIPTION OF THE FIGURES

Figure 1:
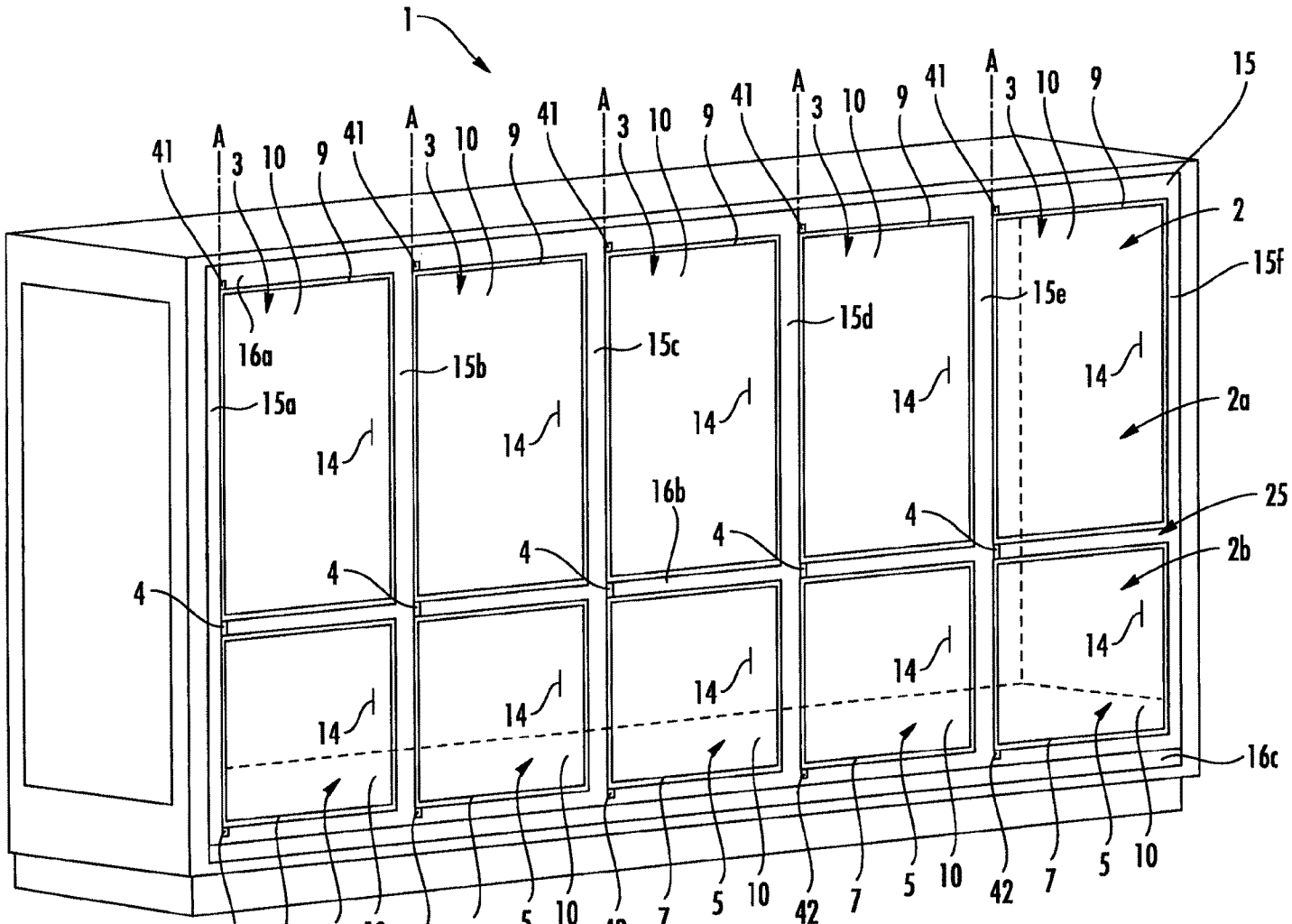
FIG. 1 shows a schematic three dimensional sketch of a refrigerated sales furniture.

FIG. 1 shows a three dimensional schematic sketch of a refrigerated sales furniture 1 according to an exemplary embodiment of the invention comprising a frame 15 enclosing at least one refrigerated goods storage space 2 having a first (upper) refrigerated goods storage space portion 2*a* and a second (lower) refrigerated goods storage space portion 2*b*.

The frame 15 comprises a plurality of vertical portions 15*a*-15*f* respectively extending along the height of the refrigerated sales furniture 1 and three horizontal portions 16*a*, 16*b*, 16*c*, namely an upper horizontal portion 16*a*, a lower horizontal portion 16*c* and an intermediate horizontal portion 16*b* arranged in between of the upper horizontal portion 16*a* and the lower horizontal portion 16*c*.

The refrigerated goods storage space 2 is accessible via a plurality of pairs of doors 3, 5 arranged at the refrigerated sales furniture's 1 front side, each pair comprising a first (upper) swinging door 3 and a second (lower) swinging door 5. Each of the doors 3, 5 comprises a door frame 7, 9 housing a glass panel 10. A handle 14 is attached to the glass panel 10 and/or the frame 7, 9 for grabbing and moving the respective door 3, 5.

The two doors 3, 5 of each pair are attached to the refrigerated sales furniture's 1 frame 15 by means of a common hinge 4, which is provided in a gap 25 formed between the upper door 3 and the lower door 5, the gap 25 extending in a horizontal orientation from the left side to the right side of the refrigerated sales furniture's 1 front side. The intermediate horizontal portion 16*b* of the frame 15 extends horizontally along the width of the refrigerated sales furniture's 1 front side.

The two doors 3, 5 are additionally attached to the frame 15 by means of an upper hinge 41 provided at the upper end of the upper door 3 and a lower hinge 42 provided at the lower end of the lower door 5, respectively.

The hinges 4, 41, 42 are arranged along a common vertical axis A extending parallel to the vertical direction of the frame 15 allowing the two doors 3, 5 to pivot around said vertical axis A to be opened and closed.

Figure 2:
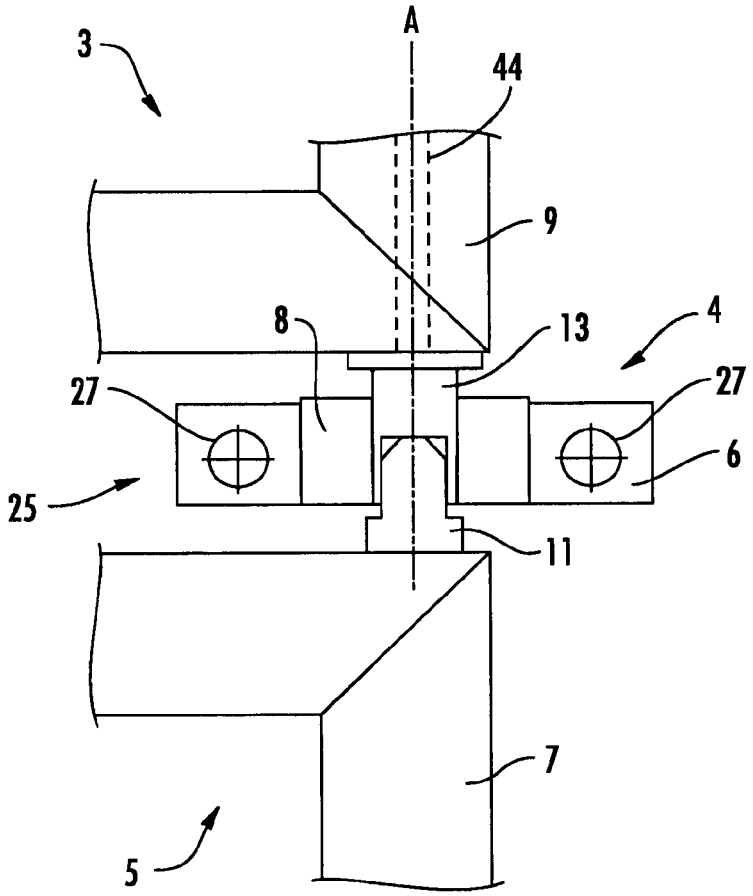
FIG. 2 shows an enlarged view of a hinge according to a first exemplary embodiment of the invention.

FIG. 2 shows an enlarged view of a hinge 4 according to a first exemplary embodiment of the invention.

The hinge 4 is arranged in the gap 25 formed between a frame 9 of the upper door 3 and a frame 7 of the lower door 5.

A first (lower) "male" pin 11 is attached to the upper end of the frame 7 of the lower door 5 and a second (upper) "female" pin 13 is attached to the bottom of the frame 9 of the upper door 3.

The upper pin 13, which is attached to the upper door 3, is provided with an opening at its bottom, said opening facing the frame 7 of the lower door 5 and accommodating the lower pin 11 in a rotatable state.

The male lower pin 11 may be provided with a tip at its upper front side facing the upper pin 13 in order to minimize the contact area and in consequence the friction between the two pin 11, 13. Such a tip, however, is only an optional feature and the invention may be implemented with male pins 11 having a rounded or even flat front surface, as well.

Thus, combination of the two pins 11, 13 provides a hinge 4 allowing the pins 11, 13 and thereby also the doors 3, 5 attached to said pins 11, 13 to rotate with respect to each other and with respect to the frame 15, which is not shown in FIG. 2, of the refrigerated sales furniture 1 around the axis A extending along the length of the pins 11, 13 and parallel to the vertical extension of the refrigerated sales furniture's 1 frame 15.

A bearing 8 is provided around the outer circumference of the second pin 13, the bearing 8 being attached to the frame 15 by means of a surrounding bracket (pipe-clamp) 6, which is attached to the frame 15 by means of fastening elements 27, such as bolts, pins or screws. Alternatively or additionally, the bracket 6 may be glued, fused or welded to the frame 15.

The bearing 8 allows the second pin 13 to rotate easily with respect to the bracket 6 and the frame 15, which allows the upper door 3 to open and close in a swinging (pivoting) motion.

In an alternative embodiment, the bracket 6 my be formed with a hole having a ellipsoid or polygonal circumference and at least one of the pins 11, 13 may be provide with an ellipsoid or polygonal cross section so that the pin 11, 13 is not rotatable with respect to the bracket 6. In this case, a bearing is provided within the respective door frame 7, 9 allowing the door frame 7, 9 to rotate with respect to the pin 7, 9 for opening/closing the door 3, 5.

In this case, both ends of a twistable leaf spring 44 may be connected to the door frame 7, 9 and the associated pin 11, 13, respectively, forming a self-closing mechanism, which ensures that the doors 3, 5 are closed when no person is present at the refrigerated sales furniture 1 in order to avoid refrigerated air from flowing out of the refrigerated storage space 2.

In the hinge 4, as it is shown in FIG. 2, the weight of the upper door 3 is completely supported by the lower door 5 by means of the pins 11, 13. Thus, the hinge 4 and in particular the bracket 6 do not bear any weight, but are only provided to avoid a lateral movement of the pins 11, 13, which would result in the vertical arrangement of the pins 11, 13 and the doors 3, 5 to collapse.

Thus, the bearing 4 and the bracket 6 do not need to provide much stability in the vertical direction and therefore may be produced from a light material at low costs.

The structure described before further allows the bearing 8 to have a low dimension in the vertical direction resulting in a small gap 25 between the upper door 3 and lower door 5. Such a small gap 25 allows maximum flexibility when accessing the goods storage space 2 and it is beneficial from an optical point of view.

Figure 3:
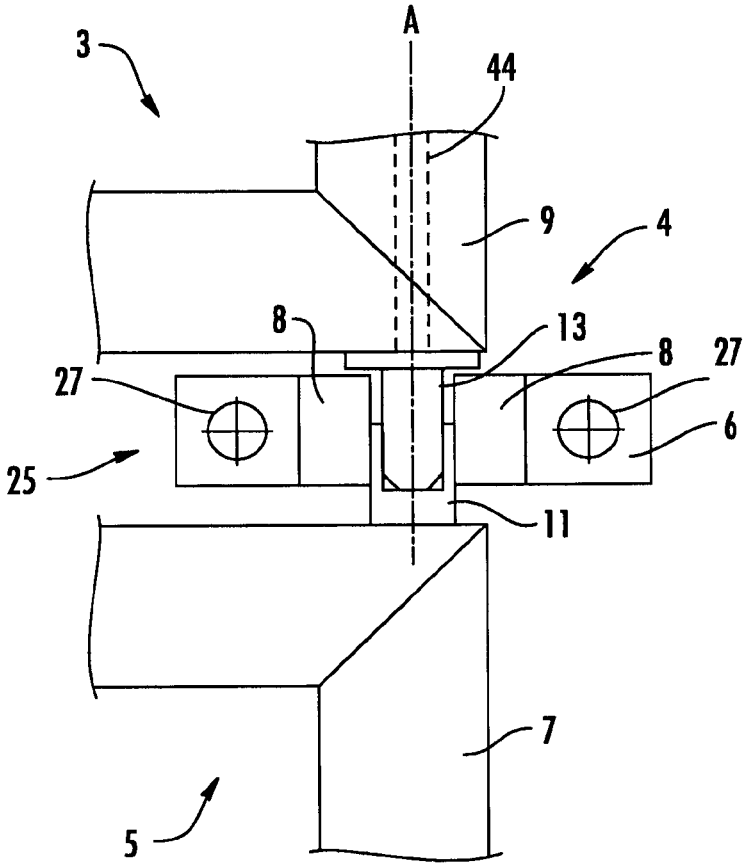
FIG. 3 shows an enlarged view of a hinge according to a second exemplary embodiment of the invention.

FIG. 3 shows a second exemplary embodiment of the hinge 4, the second embodiment being very similar to the first embodiment shown in FIG. 2. Therefore the same features are provided with the same reference signs and will not be discussed in detail again.

In the second embodiment, as it is shown in FIG. 3, the upper pin 13 is provided as a male pin 13, whereas the lower pin 11 is provided as a female pin 11 housing the upper, male pin 13.

Figure 4:
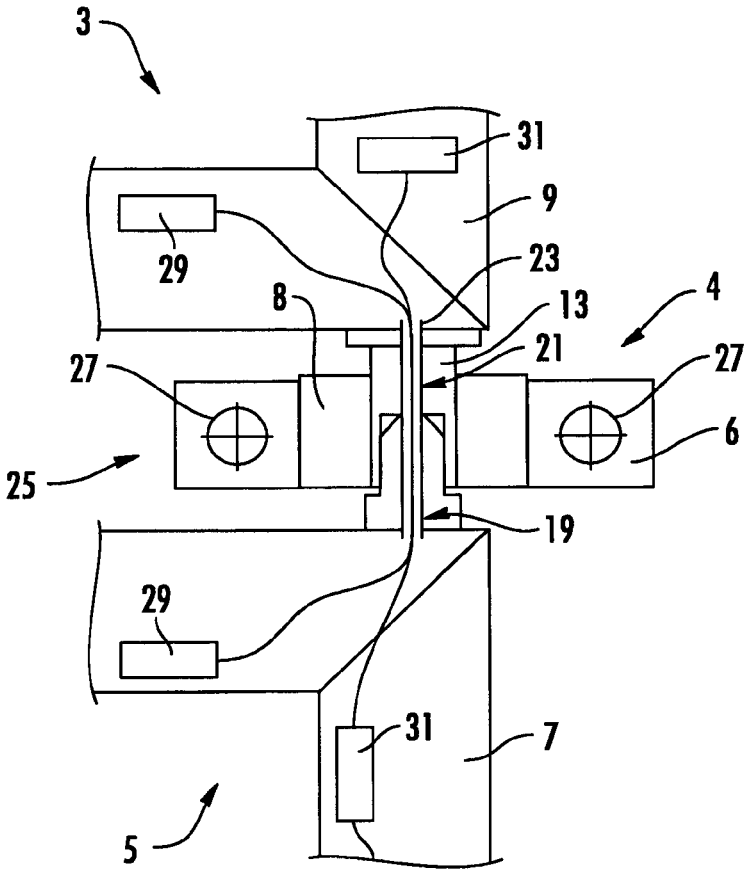
FIG. 4 shows an enlarged view of a hinge according to a third exemplary embodiment of the invention.

In a third embodiment, which is shown in FIG. 4, an electrical cable 17 is passed from the upper door's 3 frame 9 through openings 19, 21, which are respectively formed in the two pins 11, 13 extending along the axis A, to the lower door's 5 frame 7. Such an electrical cable 17, which may include one electrical wire or a plurality of wires, provides a convenient electrical connection between the two door frames 7, 9.

Such a electrical connection may be used e.g. for operating an electrical heater 31, which is provided within the door frames 7, 9, in order to avoid the condensation of ambient air on the surface of said door frames 7, 9 when they are cooled to low temperatures during operation of the refrigerated sales furniture 1. Alternatively or additionally, the electrical connection may be used for operating a lighting 29 provided at or within the door frames 7, 9 for illuminating the goods storage space 2.

A bushing 23 may be provided within the openings 19, 21 in order to avoid a twisting of the cable 17 when the doors 3, 5 are opened and closed in a pivoting/swinging motion rotating the pins 11, 13.

Further Embodiments

In an embodiment the upper pin is formed as a male pin, which is accommodated in a recess, which is provided in the lower (female) pin. Alternatively, the lower pin may be formed as a male pin, which is accommodated in a recess provided in the upper (female) pin.

Accommodating a first pin, which is formed as a male pin, in a corresponding second, female pin provides a secure but rotatable connection between the two pins and allows to support the weight of an upper door connected to the upper pin by the lower pin and a lower door, which is connected to said lower pin.

In an embodiment at least one of the pins is rotationally symmetric with respect to an axis in order to allow a rotation of said pin and a door connected to said pin around said axis.

In an embodiment the pins are secured against a movement in the horizontal direction by means of a bracket fixed to the refrigerated sales furniture in order to avoid an undesired lateral movement of the pins. Such a bracket in particular may be fixed to a frame of the refrigerated sales furniture. As such a bracket does not bear any weight, in particular not the weight the upper door, it may be implemented having a simple, lightweight and inexpensive structure.

In an embodiment a bearing is provided between the pins and the surrounding bracket in order to allow an easy rotation of the pins, in particular the female pin, with respect to the bracket.

In an embodiment at least one of the doors comprises a frame and the pin is attached to the frame. A door frame provides a suitable means for attaching the pins to the door.

In an embodiment an electrical cable extends from one of the doors to the other door through the pins. Passing an electrical cable through the pins allows to provide a convenient electrical connection between the doors, e.g. for operating an electrical heating device or an illumination device, which are provided for heating the frame or for illuminating the goods storage space and the goods which are presented therein, respectively.

In an embodiment at least one of the doors comprises a self-closing mechanism for automatically closing the door ensuring that the door is closed when no person is present at the refrigerated sales furniture in order to avoid refrigerated air from flowing out of the refrigerated storage space. The self-closing mechanism may include moving weight and/or a leaf spring, which is twisted, when one of the doors is opened.

In an embodiment the frame supports a glass panel, in particular a panel of insulating glass comprising a plurality of glass panes in order to provide a good thermal insulation of the refrigerated goods storage space. Doors comprising a plurality of glass panes have a large weight but this weight does not need to be supported by the hinge in refrigerated sales furniture according to exemplary embodiments of the invention.

In an embodiment at least one of the frames comprises a heater for heating the frame in order to avoid the condensation of moisture from ambient air on the frame.

In an embodiment at least one of the frames comprises a lighting for illuminating the goods storage space and the goods presented therein.

In an embodiment the pins are respectively provided with an opening allowing to pass a cable from the upper door to the lower door in particular for providing electrical energy to the heater and/or to the lighting. The openings are in particular oriented coaxially along the central axis of the pins. A bushing may be provided in the opening in order to avoid a twisting of the cable when the doors are moved.

In an embodiment the refrigerated sales furniture is configured to cool the refrigerated goods storage space to temperatures between 0° C. and 7° C. for storing and presenting cooled goods. The refrigerated sales furniture also may be configured to cool the refrigerated goods storage space to freezing temperatures between −20° C. and 0° C. in order to store and present (deep) frozen goods.

The refrigerated sales furniture in particular may comprise a first refrigerated goods storage space, which is cooled to temperatures between 0° C. and 7° C., and a second refrigerated goods storage space, which is cooled to freezing temperatures between −20° C. and 0° C.

In an embodiment the first refrigerated goods storage space is confined by one of the at least two doors and the second goods storage space is confined by the other one of the at least two doors allowing selective access to the refrigerated goods storage spaces which are cooled to different temperatures. This allows an economic operation of the refrigerated sales furniture as it avoids an unnecessary flow of refrigerated air from a non-accessed storage space.

While the invention has been described with reference to exemplary embodiments, it will be understood by those skilled in the art that various changes may be made and equivalence may be substitute for elements thereof without departing from the scope of the invention. E.g. FIG. 1 shows an embodiment including five pairs of doors. The skilled person, however, easily understands, that the invention may be implemented without substantial modifications in a refrigerates sales furniture comprising only a single pair of doors, two, three or four, or even more than five pairs of doors, as well.

In addition, modifications may be made to adapt a particular situation or material to the teachings of the invention without departing from the essential scope thereof. Therefore, it is intended that the invention is not limited to the particular embodiments disclosed, but that the invention will include all embodiments falling within the scope of the pending claims.

REFERENCE NUMERALS

1 refrigerated sales furniture
2 goods storage space
2*a* first (upper) refrigerated goods storage space portion
2*b* second (lower) refrigerated goods storage space portion
3 upper door
4 hinge
5 lower door
6 bracket
7 frame of the lower door
8 bearing
9 frame of the upper door
10 glass panel
11 first pin
13 second pin
14 handle
15 frame
15*a*-15*f* vertical portions of the frame
16*a* upper horizontal portions of the frame
16*b* intermediate horizontal portions of the frame
16*c* lower horizontal portions of the frame
17 cable
19 opening in the first pin
21 opening in the second pin
23 bushing
25 gap
27 fastening element
29 lighting
31 heater
41 upper hinge
42 lower hinge
44 self-closing mechanism/leaf spring

The invention claimed is:

1. Refrigerated sales furniture comprising:

at least one refrigerated goods storage space;

at least two doors providing access to the refrigerated goods storage space, the at least two doors comprising a lower door, and an upper door arranged on top of the lower door;

the refrigerated sales furniture further comprising:

a hinge, which is arranged between the upper door and the lower door for supporting the upper door on the lower door and allowing the doors to pivot around a vertical axis (A) independently from each other;

the hinge comprising an upper pin attached to or integral with the upper door and a lower pin attached to or integral with the lower door, wherein the upper pin is supported by the lower pin and the two pins are rotatable with respect to each other around the vertical axis (A);

wherein the upper pin is accommodated within the lower pin, wherein the upper pin in particular has a male shape and the lower pin in particular has a female shape.

2. Refrigerated sales furniture comprising:

at least one refrigerated goods storage space;

at least two doors providing access to the refrigerated goods storage space, the at least two doors comprising a lower door, and an upper door arranged on top of the lower door;

the refrigerated sales furniture further comprising a hinge, which is arranged between the upper door and the lower door for supporting the upper door on the lower door and allowing the doors to pivot around a vertical axis (A) independently from each other;

the hinge comprising an upper pin attached to or integral with the upper door and a lower pin attached to or integral with the lower door, wherein the upper pin is supported by the lower pin and the two pins are rotatable with respect to each other around the vertical axis (A);

wherein the lower pin is accommodated within the upper pin, wherein the lower pin in particular has a male shape and the upper pin in particular has a female shape.

3. Refrigerated sales furniture of claim 2, wherein at least one of the pins is rotationally symmetric with respect to the axis (A).

4. Refrigerated sales furniture of claim 2, further comprising a frame which includes an intermediate horizontal portion located between the upper door and the lower door.

5. Refrigerated sales furniture of claim 2, wherein the pins are secured against a lateral movement by means of a bracket which is fixed to the refrigerated sales furniture.

6. Refrigerated sales furniture of claim 5, further comprising a bearing arranged between the pins and the bracket.

7. Refrigerated sales furniture of claim 2, wherein at least one of the doors comprises a self-closing mechanism which is configured for closing the door automatically.

8. Refrigerated sales furniture of claim 2, wherein at least one of the doors comprises a door frame and the pins are attached to said door frame.

9. Refrigerated sales furniture of claim 8, wherein the frame supports a glass panel, in particular a panel of insulating glass comprising a plurality of glass panes, and/or wherein at least one of the frames comprises a heater and/or a lighting.

10. Refrigerated sales furniture of claim 2, wherein the pins are respectively provided with an opening allowing to pass a cable from one of the doors to the other door, wherein the openings are in particular oriented coaxially along the axis (A).

11. Refrigerated sales furniture of claim 2, the refrigerated sales furniture being configured to cool the refrigerated goods storage space to temperatures between 0° C. and 7° C. and/or to freezing temperatures between −20° C. and 0° C., wherein the refrigerated sales furniture in particular comprises a first refrigerated goods storage space portion, which is cooled to temperatures between 0° C. and 7° C., and a second refrigerated goods storage space portion, which is cooled to freezing temperatures between −20° C. and 0° C.

12. Refrigerated sales furniture of claim 11 wherein the first refrigerated goods storage space portion is confined by a first one of the at least two doors and the second goods storage space portion is confined by the other one of the at least two doors.

13. Refrigerated sales furniture comprising:

at least one refrigerated goods storage space;

at least two doors providing access to the refrigerated goods storage space, the at least two doors comprising a lower door, and an upper door arranged on top of the lower door;

the refrigerated sales furniture further comprising a hinge, which is arranged between the upper door and the lower door for supporting the upper door on the lower door and allowing the doors to pivot around a vertical axis (A) independently from each other;

the hinge comprising an upper pin attached to or integral with the upper door and a lower pin attached to or integral with the lower door, wherein the upper pin is supported by the lower pin and the two pins are rotatable with respect to each other around the vertical axis (A);

wherein the pins are secured against a lateral movement by means of a bracket which is fixed to the refrigerated sales furniture;

wherein the bracket does not bear any weight of the upper door.

14. Method of mounting an upper door and a lower door to a refrigerated sales furniture, wherein the upper door comprises an upper pin at its bottom;

the lower door comprises a lower pin at its top; and one of the pins is formed as a female pin comprising an opening which is configured for receiving and accommodating at least a portion of the other pin which is formed as a male pin;

the method comprising:

attaching the bottom of the lower door to the refrigerated sales furniture at a lower hinge;

introducing the male pin into the female pin in order to support the upper door onto the lower door;

attaching the top of the upper door to the refrigerated sales furniture at an upper hinge; and securing the pins against a movement in horizontal direction by means of a bracket which is fixed to the refrigerated sales furniture in particular to a frame of the refrigerated sales furniture.

* * * * *